United States Patent [19]

Doucin et al.

[11] 4,204,340

[45] May 27, 1980

[54] INSTALLATION FOR TREATING A PRODUCT IN A GASEOUS MEDIUM

[75] Inventors: Guy Doucin, Thann; Paul Marchal, Garches, both of France

[73] Assignee: Air Industrie, Courbevoie, France

[21] Appl. No.: 902,959

[22] Filed: May 4, 1978

[30] Foreign Application Priority Data

May 18, 1977 [FR] France ..... 77 15381

[51] Int. Cl.[2] ..... F26B 13/02

[52] U.S. Cl. ..... 34/225; 34/233; 34/241

[58] Field of Search ..... 34/212, 218, 219, 224, 34/225, 226, 232, 233, 241

[56] References Cited

U.S. PATENT DOCUMENTS

| | | | |
|---|---|---|---|
| 2,627,838 | 2/1953 | Huggins | 34/225 X |
| 3,128,160 | 4/1964 | Bascom | 34/232 X |
| 3,256,616 | 6/1966 | McGoldrick | 34/226 X |
| 3,285,693 | 11/1966 | Madl | 34/226 |
| 3,309,835 | 3/1967 | Peppler | 34/225 X |
| 3,324,844 | 6/1967 | Huffman | 34/225 X |
| 3,435,751 | 4/1969 | Goodman et al. | 34/224 X |
| 3,717,939 | 2/1973 | Mitchell | 34/232 X |

*Primary Examiner*—Edward G. Favors

*Attorney, Agent, or Firm*—Ostrolenk, Faber, Gerb & Soffen

[57] ABSTRACT

According to the invention, the installation for treating a product in a gaseous medium, particularly a heat treatment or drying installation, comprises at least one blowing box provided with at least one blowing wall opposite which is located the product to be treated, this blowing wall being supplied with treatment gas by supply means. The supply means comprises at least one fan disposed on one of the sides of the blowing box called "blowing side", this fan feeding a central duct supplying the central part of the blowing wall and extending perpendicularly to this blowing side as far as the opposite side called "open side", and two end ducts supplying respectively the two end parts of the blowing wall and extending parallel to the central duct from the open side as far as the blowing side, these two end ducts being fed by the central duct through two bends causing the treatment gas to make a half-turn.

13 Claims, 3 Drawing Figures

INSTALLATION FOR TREATING A PRODUCT IN A GASEOUS MEDIUM

The invention relates to installations for treating a product in a gaseous medium which comprise at least one blowing box provided with at least one blowing wall opposite which is to be found the product to be treated.

Generally, the product moves in relation to the blowing wall, in a continuous or discontinuous manner, the product being then supported by a conveying device or having the form of a strip which, under the action of appropriate means, travels continuously or discontinuously. The product could just as well be static, in which case it would be introduced opposite the blowing wall for the desired treatment time.

Supply means are provided for supplying the blowing wall with treatment gas and the problem which we are faced with is to arrange the installation so that these means may supply the blowing wall as homogeneously as possible. It is in fact due to a proper homogeneity of the supply for the blowing wall that a homogeneous treatment of the product may be obtained whatever its situation opposite the blowing wall.

Now, up to the present time, the solutions chosen have not been entirely satisfactory for it was not possible to obtain both a proper homogeneity of the supply for the blowing wall and a satisfactory general arrangement of the installation, not only from the economical point of view but also from the point of view of space occupied and accessibility.

Among these solutions chosen, the following can be mentioned:

arrangement of the supply means laterally in relation to the blowing wall; this solution, fairly satisfactory from the point of view of the general arrangement of the installation, has the disadvantage of leading to a supply for the blowing wall which is not homogeneous;

arrangement of the supply means on each side of the blowing wall; this solution, fairly satisfactory in so far as the homogeneity of the supply for the blowing wall is concerned, presents the disadvantage of leading either to the use of a large number of fans (costly installation) or else to the use of distribution ducts for the treatment gas (a cumbersome installation and difficulty of access).

The invention has as an aim an installation in which the blowing wall is supplied homogeneously with treatment gas by supply means requiring a minimum of fans while being compact and offering good accessibility, particularly at the treatment zone located opposite the blowing wall.

The treatment installation of the invention comprises at least one blowing box provided with at least one blowing wall opposite which is to be found the product to be treated, this blowing wall being fed with treatment gas by supply means and it is characterised by the fact that these supply means comprise at least one fan disposed on one of the sides of the blowing box called "blowing side", this fan supplying a central duct feeding the central part of the blowing wall and extending perpendicularly to this blowing side as far as the opposite side called "open side", and two end ducts, preferably disposed symmetrically in relation to the central duct, supplying respectively the two end parts of the blowing wall and extending parallel to the central duct from the open side as far as the blowing side, these two end ducts being fed by the central duct through two bends causing the treatment gas to make a half-turn.

According to one embodiment of the invention relative to an installation comprising two blowing walls opposite each other and defining a treatment zone in which the product to be treated is to be found, there are provided two central ducts each fed by one or more fans and four end ducts, this assembly being arranged so that the two central ducts are disposed symmetrically in relation to the treatment zone and so that the four end ducts are disposed symmetrically two by two in relation to said treatment zone.

According to another embodiment of the invention relative to an installation comprising two blowing walls opposite each other and defining a treatment zone in which the product to be treated is located, there is provided a central duct fed by one or more fans and divided into two parts symmetrically disposed in relation to the treatment zone, and four end ducts symmetrically disposed in twos in relation to said treatment zone.

In order to ensure the discharge of the treatment gas, while still ensuring a proper homogeneity of the treatment, discharge passages pass through the central duct and the two end ducts. These discharge passages connect the blowing wall to a recovery duct, which is itself connected to the suction side of the fan, when it is a matter of an installation operating in a totally or partially closed circuit.

These discharge passages may be arranged in the form of hollow dividing walls extending longitudinally in the central duct and the two end ducts and/or between said ducts. They may also be formed by an assembly of individual passages in the form of a chimney.

When it is a matter of a heat treatment or drying installation, heating means are then provided at the suction side of the fan.

From the constructional point of view, it should be pointed out that the section of the central duct diminishes from the blowing side to the open side and that the section of the two end ducts diminishes from the open side to the blowing side. The recovery duct has then its greatest section at the suction side of the fan. Such an arrangement allows a particularly compact installation to be constructed.

When it is a matter of an installation in which the product moves continuously or discontinuously, the direction of movement of this product takes place perpendicularly to the direction of flow of the treatment gas in the central duct and the two end ducts.

In the case of a complex installation, this may be constructed from a plurality of cells disposed side by side, each cell, formed essentially by a box and its accessories, being entirely self-contained, not only in so far as its supply means are concerned but also in so far as its heating means are concerned.

The invention consists, apart from the arrangements which have just been discussed, of certain other arrangements which are used preferably at the same time and which will be discussed more explicitly hereafter.

The invention will, in any case, be well understood with the help of the complement of description which follows as well as the accompanying drawings, which complement and drawings are relative to preferred embodiments of the invention and have, of course, no limitative character.

FIG. 1 of these drawings is a cross-sectional view of an installation according to the invention.

Figure 1:
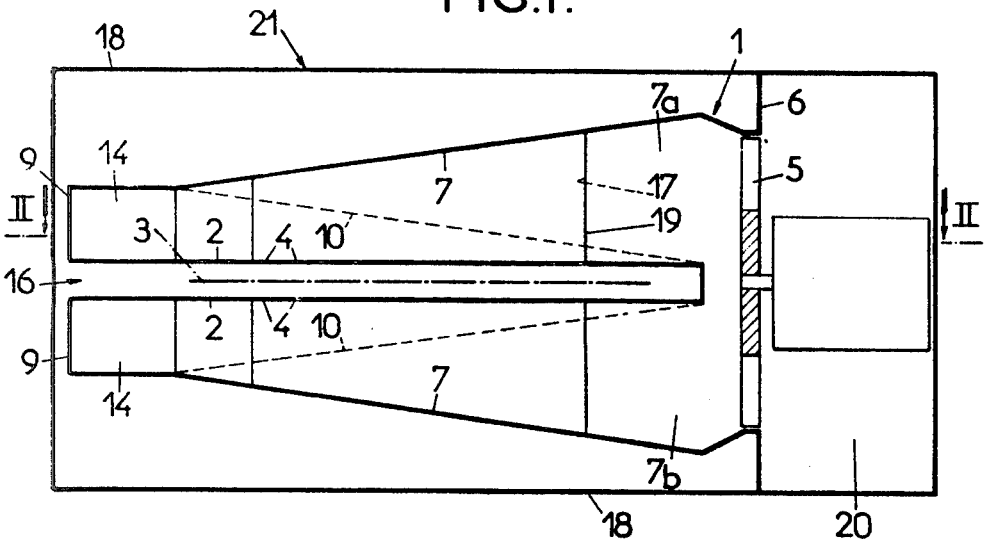
Figure 2:
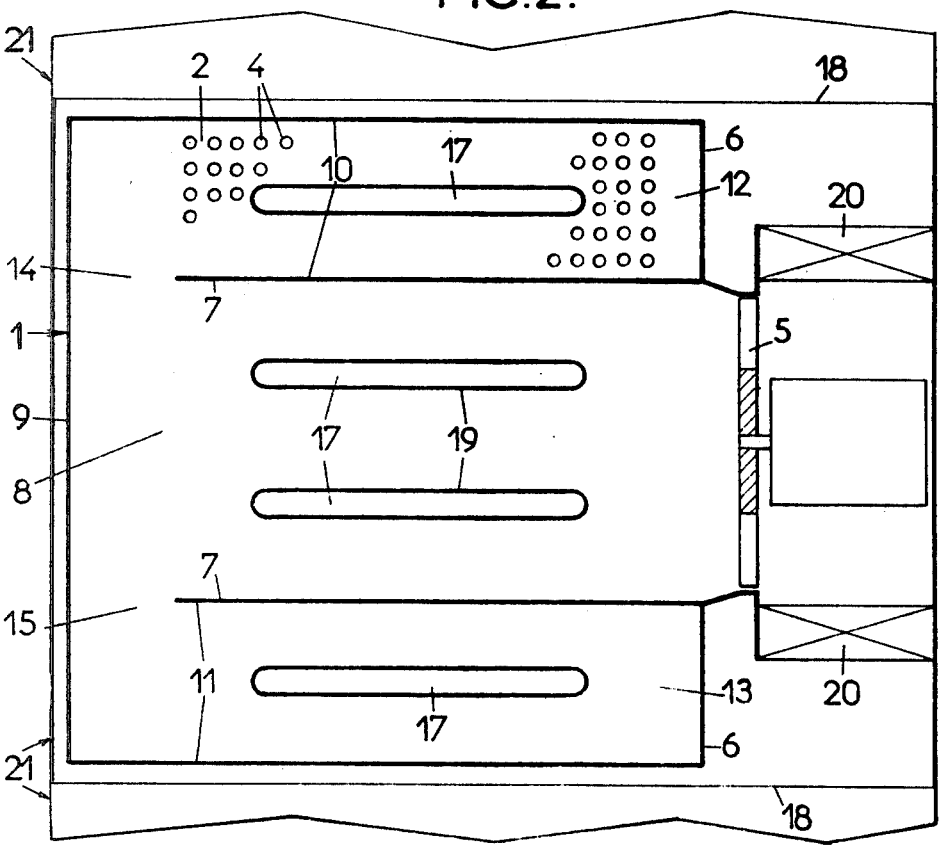
FIG. 2 is a section along II—II of FIG. 1.
Figure 3:
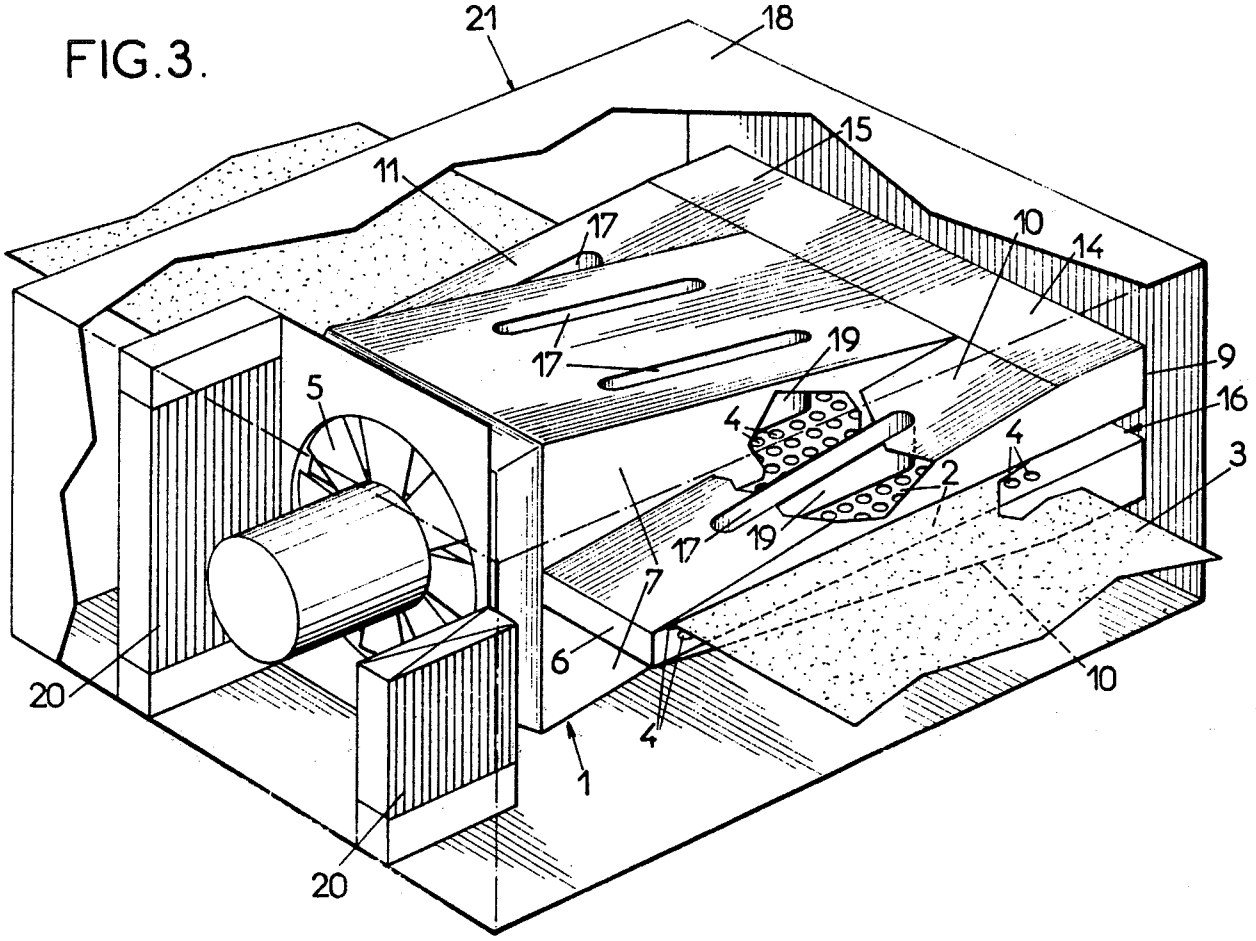
FIG. 3 is a schematical view in section, with parts cut away, of a box for an installation in accordance with the invention.

As shown in FIGS. 1 to 3, the installation comprises at least one blowing box 1 provided with at least one blowing wall 2 opposite which is to be found the product to be treated 3 (FIG. 1). This blowing wall 2 is provided with blowing apertures 4, respectively spaced, through which the treatment gas reaches the product 3 (FIG. 2).

Product 3 moves in relation to the blowing wall, in a continuous or discontinuous manner, the product then being supported by a conveyor device or being formed in the shape of a strip which, under the action of appropriate means (not shown) travels in a continuous or discontinuous manner.

Supply means are provided for supplying blowing wall 2 with treatment gas.

These supply means comprise at least one fan 5 disposed on one of the sides of the blowing box, blowing side 6, this fan 5 feeding a central duct 7 supplying the central part 8 of blowing wall 2 and extending perpendicularly to this blowing side as far as the opposite side, the open side 9.

These supply means comprise furthermore two end ducts 10 and 11, disposed preferably symmetrically in relation to central duct 7, supplying respectively the two end parts 12 and 13 of blowing wall 2 and extending parallel to central duct 7 from the open side 9 as far as the blowing side 6, these two end ducts 10 and 11 being fed by the central duct 7 through bends, respectively 14 and 15, which cause the treatment gas to make a half-turn.

According to the embodiment of the invention illustrated in FIGS. 1 to 3 and which is relative to an installation comprising two blowing walls 2 opposite each other and defining a treatment zone 16 in which is located the product to be treated 3, there is provided a central duct 7 fed by a fan 5 and divided into two parts 7*a* and 7*b* symmetrically disposed in relation to treatment zone 16 and four end ducts, two ducts 10 and two ducts 11, disposed symmetrically in twos in relation to said treatment zone 16.

To ensure the discharge of the treatment gas, while still ensuring a proper homogeneity of the treatment, discharge passages 17 pass through central duct 7 and the two end ducts 10 and 11. These discharge passages 17 connect blowing wall 2 to a recovery duct 18, which is itself connected to the suction side of fan 5, when it is a matter of an installation operating in a totally or partially closed circuit.

These discharge passages 17 may be arranged in the form of hollow dividing walls 19 extending longitudinally in the central duct 7 and the two end ducts 10 and 11, and/or between said ducts. They may also be formed by an assembly of individual passages in the form of a chimney.

Heating means 20 are then provided at the suction side of fan 5.

The section of central duct 7 diminishes from the blowing side 6 to the open side 9 and the section of the two end ducts 10 and 11 diminishes from the open side to the blowing side 6. Recovery duct 18 has then its greatest section at the suction side of the fan. This recovery duct 18 may have a parallelelepipedic outer shape whose outer walls may form the floor and the ceiling, possibly insulated, of a cell 21.

As clearly shown in FIGS. 2 and 3, the direction of movement of product 3 takes place perpendicularly to the flow direction of the treatment gas in the central duct and the two end ducts.

The installation comprises generally a plurality of cells 21 disposed side by side (FIG. 2).

From the constructional point of view, it should be pointed out that the central part 8 of the blowing wall fed by central duct 7 has an area double that of each of the two end parts 12 and 13 of the blowing wall fed respectively by end ducts 10 and 11.

In so far as the heating means 20 are concerned, they may be placed on each side of fan 5 if this latter is an axial fan (FIGS. 2 and 3). If the fan is a centrifugal fan, the heating means 20 may be disposed in the suction or delivery conduit of such a fan.

The heating means 20 may be formed by exchangers, re-heaters, or batteries of burners.

Generally these heating means 20 are preceded by filter devices (not shown).

Finally, and whatever the embodiment adopted, there is provided an installation whose principal advantages are the following:

an homogenous supply of the or both blowing walls with the treatment gas, more compact, good accessibility, particularly of the treatment zone, simple and even outer geometrical shape, possibility of constructing an installation comprising a plurality of cells independent of each from the point of view of ventilation, heating and control.

As is evident, and as it follows moreover already from what has gone before, the invention is in no wise limited to those of its modes of application and embodiments which have been more particularly considered; it embraces, on the contrary, all variations thereof.

We claim:

1. An installation for treating a moving strip product in a gaseous medium, particularly for heating and/or drying of said strip, comprising at least one blowing box provided with a perforated blowing wall in front of which the strip moves, said perforated blowing wall comprising, along the moving direction of the strip, a first lateral portion, a central portion and a second lateral portion, said blowing box being supplied with a treatment gas by at least one fan disposed on one side of said blowing box, said fan feeding a central duct supplying the central portion of the perforated blowing wall, said central duct extending perpendicularly to the moving direction of the strip, the end of said central duct opposite to the fan being connected by means of two 180° knee pipes to two blind lateral ducts supplying the two lateral portions of the perforated blowing wall.

2. An installation according to claim 1, wherein the two lateral ducts are disposed symmetrically in relation to the central duct.

3. An installation according to claim 1 or 2 comprising two perforated blowing walls opposite each other and defining a treatment zone in which the strip moves, wherein there is provided at least one central duct fed by at least one fan, and four lateral ducts, this assembly being arranged so that the central duct is disposed symmetrically in relation to the treatment zone and so that the four lateral ducts are disposed symmetrically in twos in relation to said treatment zone.

4. An installation according to claim 3 having two central ducts each fed by a fan and each central duct having two of the four lateral ducts disposed symmetrically in relation thereto.

5. An installation according to claim 3, comprising discharge passages passing through the central duct and the lateral ducts.

6. An installation according to claim 5, in which the discharge passages connect the treatment zone to a recovery duct while connected to the suction side of the fan.

7. An installation according to claim 6, wherein the recovery duct has its largest section at the suction side of the fan.

8. An installation according to claim 6, wherein the recovery duct has a parallelepipedic outer shape.

9. An installation according to claim 5, in which the discharge passages are arranged in the form of hollow dividing walls extending longitudinally in the central duct and the two lateral ducts.

10. An installation according to claim 5, in which the discharge passages are formed by an assembly of individual passages in form of a chimney.

11. An installation according to claim 3 further comprising heating means provided at the suction or at the delivery side of the fan.

12. An installation according to claim 1 in which the section of the central duct diminishes from the fan to the opposite end and the section of the two end ducts diminishes from the 180° knee pipes to the opposite end.

13. An installation according to claim 1, wherein the central portion of the perforated blowing wall has a surface double that of each of the two lateral portions of the perforated blowing wall.

* * * * *